US006800572B1

(12) United States Patent
Rieger et al.

(10) Patent No.: US 6,800,572 B1
(45) Date of Patent: Oct. 5, 2004

(54) FIBROUS MATERIAL COMPRISING FIBERS MADE FROM LINEAR ISOTACTIC POLYMERS

(75) Inventors: Bernhard Rieger, Ulm (DE); Mike Orroth, Richmond (GB); Gian De Belder, Lier (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/089,341

(22) PCT Filed: Oct. 2, 2000

(86) PCT No.: PCT/US00/27134

§ 371 (c)(1),
(2), (4) Date: Mar. 27, 2002

(87) PCT Pub. No.: WO01/27372

PCT Pub. Date: Apr. 19, 2001

(30) Foreign Application Priority Data

Oct. 8, 1999 (EP) ..... 99120174

(51) Int. Cl.[7] ..... D04H 13/00; D02G 3/02

(52) U.S. Cl. ..... 442/334; 442/327; 442/329; 442/400; 442/401; 442/402; 442/407; 442/408; 442/414; 428/221; 428/222; 428/364; 428/365; 264/165; 526/348; 526/351

(58) Field of Search ..... 428/221, 222, 428/364, 365; 526/348, 351; 264/165; 442/327, 329, 334, 400, 401, 402, 407, 408, 414

(56) References Cited

U.S. PATENT DOCUMENTS 5,272,003 A * 12/1993 Peacock ..... 428/357
5,594,080 A * 1/1997 Waymouth et al. ..... 526/126
5,672,415 A * 9/1997 Sawyer et al.
5,888,607 A 3/1999 Seth et al.

FOREIGN PATENT DOCUMENTS

DE 198 16 154 A1 10/1999
WO WO 99/20664 A2 4/1999

OTHER PUBLICATIONS

Dietrich et al., "Control of Stereoerror Formation with High–Activity 'Dual–Side' Zirconocene Catalysts: A Novel Strategy To Design the Properties of Thermoplastic Elastic Polypropenes", Journal of The American Chemical Society, vol. 121, NR. 18, Mar. 21, 1999, pp. 4348–4355.

Rieger et al., "Novel Metallocene Catalyzed Polypropene Homo– and Brush–Copolymers: Control of New Morphologies and Beyond", Polymeric Materials Science And Engineering, vol. 80, Mar. 4, 1999, pp. 51–52.

* cited by examiner

*Primary Examiner*—Roberto Rabago
(74) *Attorney, Agent, or Firm*—Angela Marie Stone

(57) ABSTRACT

The present invention relates to fibrous web materials comprising polymeric material wherein the structure of the polymeric material contains elastic amorphous areas nanoscale-size reinforced with self arranged crystalline domains of nano-crystals.

10 Claims, No Drawings

FIBROUS MATERIAL COMPRISING FIBERS MADE FROM LINEAR ISOTACTIC POLYMERS

FIELD OF THE INVENTION

The present invention relates to fibrous web materials such as nonwoven materials used for example in hygienic articles. Specifically, the present invention relates to elastic fibrous web materials.

BACKGROUND

Fibrous materials and in particular nonwoven web materials comprising olefinic polymers are well known in the art and enjoy widespread usage throughout the industry. Typical areas of application of such fibrous web material include for example hygienic articles and in particular disposable absorbent articles.

Fibrous web materials made from commonly used polyolefins such as PP, PE, PS, PIB have a number of useful properties. They are bio-compatible and food compatible, chemically stabile, inert, non toxic materials. However, most of them have poor mechanical properties including insufficient strength/tear resistance, insufficient stretchability/elasticity and the like.

Several approaches have been proposed in the prior art to provide elastic properties to such fibrous web materials. The most commonly used approach—besides providing laminates of fibrous web material with for example elastic films—is based on changing the chemical structure of the polymer by introducing hinged joints/moieties into the main chain of the polymer. These hinges provide more flexibility to the polymeric backbone preventing crystallization of polymer, lowering the glass transition temperature (Tg) and improving the elasticity of the resulting material. Usually, the hinge groups contain heteroatoms providing flexibility such as oxygen, nitrogen or chlorine placed into the main chain or into bulky side groups. Another approach is mastication of the polymer by blending with special plasticizing agents. Both approaches, however, require heteroatoms to be introduced into the molecule or into the bulk of the coating material.

The third approach proposed in the prior art to provide elastic properties to such fibrous web materials, which is more dose to the present invention, is to exploit the formation of hetero-phases which reinforce the bulk material by forming a physical net. To do this the block-copolymerization of two or more different monomers has been used leading to polymeric backbones comprising blocks with different Tg. This results in micro-phase separation in the bulk with formation of reinforcing crystalline domains of one co-polymer linked with each other by flexible chains of the second copolymer.

In essence, conventional polymeric web materials carry a wide variety of inherent disadvantages including but not being limited to insufficient strength/tear resistance, insufficient stretchability/elasticity, not being bio-compatible, not being food compatible, comprising heteroatoms such as chlorine and hence leading to toxic residues when burnt, and the like.

It is an object of the present invention to provide fibrous web materials which overcome the disadvantages of the prior art fibrous web materials.

It is an further object of the present invention to provide articles which comprise fibrous web materials.

It is an further object of the present invention to provide a method for manufacturing fibrous web material of the present invention.

It is a further object of the present invention to provide a method processing a fibrous web material of the present invention.

SUMMARY OF THE INVENTION

The present invention provides a fibrous web material comprising a plurality of fibers. The fibrous web material is characterized in that the fibers comprise a polyolefinic homopolymer having a an isotacticity of less than 60% of [mmmm] pentad concentration.

The present invention further provides a method for manufacturing fibers from the aforementioned polymeric material comprising a step of processing the polymeric material selected from the group of wet spinning, dry spinning, melt spinning, semi dry spinning (solvent evaporation or sedimentation), and combinations thereof.

The present invention further provides a method for manufacturing a fibrous web material comprising the steps of providing fibers of the aforementioned polymeric material and of combining the fibers into a web material.

The present invention further provides a method for stabilizing a fibrous web material according to the present invention comprising the steps of providing a fibrous web material and of stabilizing step the fibrous web material.

DETAILED DESCRIPTION OF THE INVENTION

The present invention provides fibrous web materials comprising polyolefinic homopolymers.

The term "polyolefinic homopolymer" as used herein refers to those polyolefins which comprise only one phase of molecules all of which exhibiting a similar stereochemical configuration. For example, blends of atactic and isotactic polymers where the two phases have polymerized simultaneously are excluded when this term is used. The term homopolymer includes copolymers where all molecules exhibit a similar stereochemical configuration.

The polyolefinic homopolymer of the present invention may comprise linear isotactic polymers having a structure of one or several $C_3$ to $C_{20}$ olefinic monomers, having an isotacticity of less than 60%, preferably less than 55%, more preferably less than 50%, and most preferably less than 45% of [mmmm] pentad concentration, and having an isotacticty of more 15%, preferably more than 20%, more preferably more than 25%, and most preferably more than of [mmmm] pentad concentration. Preferably, the polyolefinic homopolymer is polypropylene.

The isotacticity of the homopolymers may be reduced compared to the isotactic polypropylenes of the prior art due to a statistic distribution of stereoscopic errors in the polymer chain. The term "stereoscopic error" refers to a stereoscopic sequence characterized by a [mrrm] pentad. In this case, the central monomer has a stereo configuration opposed to the other four monomers in this pentad. The [mrrm] pentad concentration of this polymer therefore is above the statistical probability of $p^2(1-p)^2$ where p=[m] and hence 1−p=[r] and $p^4$=[mmmm]. Preferably, the pentad concentration is at least $[p(1-p)]^q$ p(1−p) with q being 0.8, more preferably q being 0.6, yet more preferably q being 0.4, yet more preferably q being 0.2, most preferably q being 0.1.

In some embodiments of the homopolymer and in particular in those embodiments where the crystallinity is reduced by means of single stereo errors, a low content of atactic sequences has proven beneficial to the properties of the fiber of the present invention. Preferably, the [rmrm] pentad concentration is below 6%, more preferably below 5%, yet more preferably below 4%, yet more preferably below 3%, most preferably below 2.5%.

In some embodiments of the homopolymer and in particular in those embodiments where the crystallinity is reduced by means of single stereo errors, a low content of syndiotactic sequences has proven beneficial to the properties of the fiber of the present invention. Preferably, the [rrrr] pentad concentration is below 6%, more preferably below 5%, yet more preferably below 4%, yet more preferably below 3%, most preferably below 2.5%.

Alternatively, the homopolymer of the present invention may include sequences of atactic and isotactic blocks of polymer.

Preferably, the mean molecular weight $M_w$ of the polymer is above 100000 g/mol, more preferably above 200000 g/mol, yet more preferably above 250000 g/mol, yet more preferably more than 300000 g/mol, most preferably more than 350000g/mol.

The glass temperature $T_g$ is between −50 and +30° C. Preferably the glass temperature is below 10° C., more preferably below 5° C., yet more preferably below 0° C., most preferably below −6° C. The melt temperature of the polymer is obtained after heating the sample 150° C. and subsequently cooling the polymer to −50° C.

Without wishing to be bound by this theory, the polyolefinic polymers exhibit a semi-crystalline structure. The structure contains elastic amorphous areas of nano-scale-size reinforced with self arranged crystalline domains of nano-crystals. The formation of brittle macro-crystalline material from the polymer is achieved by introducing the defects into the polymeric backbone. Isolated monomer units with opposite stereo configuration have been used as the defects, i.e. single stereo errors.

Suitable polymers and a process for manufacturing such polymers are described in PCT patent application EP99/02379 incorporated herein by reference published Oct. 21, 1999 as WO 99/52955. A catalyst combination suitable for the preparation of such polymers is described in PCT patent application EP99/02378 incorporated herein by reference published Oct. 21, 1999 as WO99/52950. Preferably, the process of PCT patent application EP99/02378 is carried out by temperatures of less than 30° C., more preferably less than 25° C., yet more preferably less than 20° C., most preferably less than 15° C. to increase the molecular weight of the resulting polymer. In order to increase the molecular weight, the polymerization is preferably carried out in liquid monomer such as in liquid propene. In order to increase the molecular weight, the catalyst is preferably used in combination with the boron activators mentioned in PCT patent application EP99/02378.

Other suitable polymers and a process for manufacturing such polymers is described in WO99/20664 incorporated herein by reference.

It is preferred to use homopolymers for the fibers of the present invention since during manufacture of homopolymers the batch to batch variability is greatly reduced in comparison to multi phase polymers where the phases are polymerized in a single reaction.

Preferably, the polymers used in manufacturing the fiber materials of the present invention have a distinctive rubber-elastic plateau in their stress strain curves.

The polymers used for the fiber of the present invention are bio-compatible may be burnt without toxic residues since they contain no heteroatoms such as chlorine. The further do not contain toxic monomer residues.

The fiber materials of the present invention have been found to be able exhibit superior softness. Preferably, the fiber material has a Shore hardness on the A scale of less than 30, more preferably, of less than 25, yet more preferably of less than 20, yet more preferably of less than 15, most preferably of less than 10. The softness of the fiber material of the present invention can be increased by manufacturing the fiber by reducing the isotacticity ([mmmm] pentad concentration).

The fiber material has been found to exhibit increased temperature stability compared to prior art fiber materials. This is partly due to the fact that for the fibers of the present invention a homopolymer is used and is partly due to the high molecular weight of the homopolymer. Preferably, the fiber material of the present invention has a melting point of at least 100° C., more preferably of at least 110° C., more preferably of at least 120° C., most preferably of at least 130° C. The melt temperature of the polymer is obtained after heating the sample 150° C. and subsequently cooling the polymer to −50° C. Higher melting point may be achieved my blending the homopolymer for example with conventional isotactic polymer such as polypropylene.

The fiber of the present invention have been found to be stretchable as well as elastic. The stretchability of the fiber versus its elastic behavior can be adjusted by means of the tacticity of the homopolymer of the present invention. The fiber material of the present invention has been found to be stretchable without tearing to at least 500% of its original length, more preferably 1000% of its original length, yet more preferably to at least 1500% of its original length, most preferably to at least 2000% of its original length. In addition, the fiber material of the present invention preferably recovers within 10 minutes after being stretched and held for 1 minute to 500% of its original length back to less than 300% its original length, preferably less than 200% its original length, most preferably less than 150% of its original length. In addition, the fiber of the present invention has been found to exhibit a low compressive set. The fiber of the present invention recovers within 10 minutes after a compression to 50% of its original thickness for 1 minute to at least 60% of its original thickness, more preferably at least 70% of its original thickness, yet more preferably to at least 80% of its original thickness, yet more preferably to at least 90% of its original thickness, most preferably to at least 95% of its original thickness. The compressibility of the fiber of the present invention can be adjusted by increasing the tacticity of the homopolymer or by blending the low tacticity homopolymer with conventional isotactic polymer such as polypropylene.

The fiber of the present invention has been found to exhibit a relative low tackiness at room temperature due to the high molecular weight of the polymer.

Various additives may be added to the homopolymer of the present invention to change the properties of the polymer such as is well known in the art.

There are known in the art a wide variety of suitable methods to manufacture and/or processing fibers from the polymer of the present invention including but not being limited to wet spinning, dry spinning, melt spinning, semi dry spinning (solvent evaporation or sedimentation), crazing, and combinations thereof. Fibers suitable for the web materials of the present invention may be mono fibers or the may comprise filaments.

For at least some of the spinning processes, it has been found that the amount of the low isotacticity homopolymer of the present invention present in the fiber of the present invention needs to be reduced in order to accelerate crystallization of the fibers after spinning. Preferably, the fiber of the present invention comprises less than 80% of the low isotacticity homopolymer, more preferably less than 60%, yet more preferably less than 40%, most preferably less than 30%. Alternatively, a high isotacticity polymer having a broader molecular weight distribution may be used in order to accelerate crystallization times.

Compared to spinning of conventional, isotactic polypropylene, the addition of the low isotacticity homopolymer of the present invention reduces the requires forces, pressures, or torques respectively to process the polymer.

There are known in the art a wide variety of suitable methods to manufacture fibrous web material according to the present invention from fibers including but not being limited to meltblowing, spunbonding, carding, air laying, wet laying, weaving, knitting, balling, and the like. There are further known in the prior art a wide variety of suitable methods for optional stabilization of the fibrous web material of the present invention including but not being limited to hydroentangling, thermo bonding, pressure bonding, air through bonding, needling, resin bonding, combinations thereof, and the like.

It is a further aspect of the present invention to provide an article comprising a fibrous web material according to the present invention.

The article according to the present invention may be a hygienic article. The term "hygienic article" as used herein refers to articles which are intended to be used in contact with or in proximity to the body of a living being. Such hygienic articles may absorbent or non-absorbent. Such hygienic articles may be disposable or intended for multiple or prolonged use. Such hygienic articles include but are not limited to disposable absorbent article (diapers, sanitary napkins, adult incontinence devices such as briefs, bed mats, wound plasters, underarm sweat pads, and the like), medical supply items (coverings, gowns, drapes, face masks, bandages, body implants, and the like), and other hygienic articles such as toys, bed covers, and the like. Having regard to the specific advantages of the polymers used for the articles of the present invention, it will be readily apparent to the skilled practitioner to apply the fibrous web materials according to the present invention in the above and similar hygienic articles.

The article of the present invention may also be a clothing article or a household article including but not being limited to bed covers, underwear, tights, socks, gloves, sport clothing, outdoor clothing, low temperature clothing, shoes and show covers, protective clothing such as for motor biking, blankets, covers, bags, items of furniture, and the like. Having regard to the specific advantages of the polymers used for the articles of the present invention, it will be readily apparent to the skilled practitioner to apply and to optionally modify the fibrous web materials according to the present invention in the above and similar articles.

The fibrous web material according to the present invention may also be used as a construction element in an article. Thereby, the functionalities of the fibrous web material includes but is not limited to supporting, carrying, fixing, protecting other elements of the article and the like. Such articles include but are not limited to adhesive tapes, protective wraps, complex constructions such as buildings (floor coverings, house wraps, and the like), cars, household appliances, horticultural and agricultural constructions (geotextiles), and the like. Having regard to the specific advantages of the polymers used for the articles of the present invention, it will be readily apparent to the skilled practitioner to apply and to optionally modify the fibrous web materials according to the present invention as construction elements in the above and similar articles.

The article of the present invention may further a membrane such as in filters, car batteries, and the like. Having regard to the specific advantages of the polymers used for the articles of the present invention, it will be readily apparent to the skilled practitioner to apply and to optionally modify the fibrous web materials according to the present invention in the above and similar articles.

What is claimed is:

1. A fibrous web material comprising a plurality of fibers characterized in that said fibers comprise a polyolefinic homopolymer having one phase of molecules all of which exhibit a similar stereochemical configuration and having an isotacticity of less than 60% and more than 15% of [mmmm] pentad concentration, a [rmrm] pentad concentration below 3%, and a [rrr] pentad concentration below 6%.

2. A fibrous web material according to claim 1 wherein said homopolymer is polypropylene.

3. An article comprising a fibrous web material according to claim 1.

4. An article according to claim 3 wherein said article is a hygienic article.

5. A hygienic article according to claim 4 wherein said article is a disposable absorbent article.

6. A method for manufacturing fibers from polymeric material comprising a step of processing said polymeric material selected from the group consisting of wet spinning, dry spinning, melt spinning, semi dry spinning (solvent evaporation or sedimentation), and combinations thereof characterized in that said polymeric material comprises a polyolefinic homopolymer having one phase of molecules all of which exhibit a similar stereochemical configuration and having an isotacticity of less than 60% and more than 15% of [mmmm] pentad concentration, a [rmrm] pentad concentration below 3%, and a [rrr] pentad concentration below 6%.

7. A method for manufacturing a fibers according to claim 6 comprising the additional step of combining said fibers into a web material.

8. A method for manufacturing a fibrous web material according to claim 7 wherein said step of combining fibers is selected from the group consisting of meltblowing, spunbonding, carding, air laying, wet laying, weaving, knitting, bailing, and combinations thereof.

9. A method for stabilizing a fibrous web material comprising the steps of providing a fibrous web material stabilizing said fibrous web material characterized in that said fibrous web material comprises a polyolefinic homopolymer having one phase of molecules all of which exhibit a similar stereochemical configuration and having an isotacticity of less than 60% and more than 15% of [mmmm] pentad concentration, a [rmrm] pentad concentration below 3%, and a [rrr] pentad concentration below 6%.

10. A method for stabilizing a fibrous web material according to claim 9 wherein said step of stabilizing is selected from the group consisting of hydroentangling, thermo bonding, pressure bonding, air through bonding, needling, resin bonding, and combinations thereof.

* * * * *

UNITED STATES PATENT AND TRADEMARK OFFICE

CERTIFICATE OF CORRECTION

PATENT NO. : 6,800,572 B1
DATED : October 5, 2004
INVENTOR(S) : Rieger et al.

It is certified that error appears in the above-identified patent and that said Letters Patent is hereby corrected as shown below:

Column 1,
Line 46, delete "dose" and insert therefor -- close --.
Line 66, delete "an" between "is" and "further" and insert therefor -- a --.

Column 2,
Line 1, delete "an" between "is" and "further" and insert therefor -- a --.

Column 3,
Line 21, delete "350000g/mol" and insert therefor -- 350000 g/mol --.

Column 4,
Line 23, delete "my" and insert therefor -- by --.
Line 65, delete "the" between "or" and "may".

Column 6,
Lines 21, 40 and 59, delete "rrr" and insert therefor -- rrrr --.
Line 42, delete "a" between "manufacturing" and "fibers".

Signed and Sealed this

Seventeenth Day of May, 2005

JON W. DUDAS
*Director of the United States Patent and Trademark Office*